US007175550B1

(12) United States Patent
Bellah, Jr. et al.

(10) Patent No.: US 7,175,550 B1
(45) Date of Patent: Feb. 13, 2007

(54) TRAINING AID FOR PITCHERS AND CATCHERS

(76) Inventors: Terry Bellah, Jr., 202 Brook La., Roswell, GA (US) 30075; Mike Laney, 235 Shandwick Pl., Alpharetta, GA (US) 30044; Danny Pralgo, 8555 Edwardton Dr., Roswell, GA (US) 30076; Mike Haverland, 1759 Tappanhannock Tr., Roswell, GA (US) 30076

( * ) Notice: Subject to any disclaimer, the term of this patent is extended or adjusted under 35 U.S.C. 154(b) by 0 days.

(21) Appl. No.: 10/986,726

(22) Filed: Nov. 12, 2004

Related U.S. Application Data

(60) Provisional application No. 60/585,812, filed on Jul. 7, 2004.

(51) Int. Cl.
*A63B 69/00* (2006.01)
*A63B 71/00* (2006.01)

(52) U.S. Cl. ..... 473/451; 473/497; 473/499

(58) Field of Classification Search ..... 473/422, 473/452, 451, 499–501; D21/780
See application file for complete search history.

(56) References Cited

U.S. PATENT DOCUMENTS

| | | | | | |
|---|---|---|---|---|---|
| 948,342 | A * | 2/1910 | Pisel | 473/499 |
| 2,122,266 | A * | 6/1938 | Seys | 473/499 |
| 3,341,199 | A * | 9/1967 | Madsen | 473/499 |
| 3,813,097 | A * | 5/1974 | Darby | 473/490 |
| 4,199,141 | A | 4/1980 | Garcia | |
| 4,463,950 | A * | 8/1984 | Elkin | 473/451 |
| 4,749,223 | A * | 6/1988 | Goeders | 473/497 |
| D367,091 | S * | 2/1996 | Purdy | D21/780 |
| 5,607,150 | A * | 3/1997 | Schnorr, III | 473/499 |
| 5,704,855 | A | 1/1998 | Kellogg, Jr. | |
| 5,707,305 | A * | 1/1998 | Goeders et al. | 473/497 |
| 6,350,211 | B1 | 2/2002 | Kolmar | |
| 6,463,605 | B2 * | 10/2002 | Swagger, Jr. | 5/420 |
| D479,295 | S * | 9/2003 | Vesledahl | D21/780 |
| 6,663,537 | B2 * | 12/2003 | McCoy | 482/23 |
| 6,790,166 | B2 * | 9/2004 | Broudy | 482/147 |
| 2004/0005942 | A1 * | 1/2004 | Wang | 473/500 |

* cited by examiner

*Primary Examiner*—Mitra Aryanpour
(74) *Attorney, Agent, or Firm*—William B. Nell

(57) ABSTRACT

A low profile, baseball training aid device to provide a proper target for the pitcher and a positioning aid for the catcher receiving the pitcher's throw. The device, preferably fabricated of a thermoplastic material, comprises a base section mounting a pair of side sections, where the side sections define pitching locations within and outside the 'strike' zone to thereby provide a more precise targeting location for the pitcher. In a preferred embodiment, the side sections may be provided with a color distinguishable surface to visually distinguish the respective side sections from the base section.

7 Claims, 2 Drawing Sheets

TRAINING AID FOR PITCHERS AND CATCHERS

RELATED APPLICATION

This application is related to and claims priority of Provisional Application Ser. No. 60/585,812, filed Jul. 7, 2004, under the same title and by the inventors hereof.

FIELD OF THE INVENTION

This invention is directed to the field of training aids for baseball pitchers and catchers. This aid assists the baseball battery, i.e. pitcher and catcher, with the proper positioning of the catcher and catcher's mitt, and instructing the pitcher to throw to certain locations over and at the 'corners' of the home plate.

BACKGROUND OF THE INVENTION

The present invention relates to the relationship between the pitcher and catcher, teaches the proper positioning of the catcher and catcher's mitt, and teaches the pitcher how to throw to certain locations over and near home plate. Throwing the baseball to certain parts of home plate remains a fundamental skill of pitching. This skill is best honed when a pitcher and catcher work together. The catcher is an indispensable part of practice as the catcher calls the pitches, establishes a target, and places his catcher's mitt in the area for the pitcher to throw to. The catcher may or may not place the catcher's mitt over the plate. If an opposing player can be induced to swing at an outside pitch, the catcher may place his glove on the outside edge of the home plate. If an opposing batter prefers a pitch on the inside, the catcher may place the catcher's mitt on the inside edge of the plate, again to induce the batter to swing at a "ball", that is outside the normal strike zone.

Throughout the history of baseball, many different pitching training devices have been created to teach professional and amateur baseball pitchers, trainers and coaches. These devices are used to train pitchers to throw in the "strike zone". The "strike zone" is an area equal in width to the size of the regulation baseball home plate (17") and is approximately 3' in height, corresponding to the height of the strike-zone of an average adult batter. However, these aids focus solely on the pitcher, and concern themselves with measuring whether the pitch is a "ball" or a "strike". In reality, the most effective pitchers work the inside and outside corners of home plate. This method is called working the corners. If a pitcher can place the baseball close to the edge of the plate, the batter must make a determination whether to swing at the baseball or not. The same is true for the umpire. If a baseball is close to the corner of the plate, he may call the pitch a strike if it appears the baseball crosses the edge of the home plate, or he may call the pitch a strike if the baseball directly makes contact with the catcher's mitt without the catcher moving his mitt.

The major problem with the prior art devices is that all such devices assume that any pitch that passes through the strike zone, a "strike" is a good pitch, and any pitch that does not pass through the strike zone is a "ball", and is not a good pitch. As explained above, it may be in the pitcher's best interest to place a pitch outside the strike zone as the batter may "chase" such a pitch. Ironically, a pitch directly over the strike zone is much more likely to be hit by the batter. Another problem with the prior art is that the catcher is completely ignored. For a pitcher to be effective, he must develop chemistry with his battery mate. This means the pitcher must become comfortable with how the catcher sets up, where the catcher places his mitt, and the signals they use to call for a fastball, curve, slider, etc.

Since the prior art ignores the catcher, the pitcher is limited to pitching to a structure that only measure whether the pitch falls within a designated area. This may improve the location of the pitches, but may not improve the effectiveness of the pitching.

Another problem with such past devices is these devices do not teach the catcher to correctly position his body and his mitt. If the catcher can position his body so that when he places his mitt directly in the center of his body and it is just slightly outside of the plate in either direction, and the pitch hits the mitt without the catcher moving the mitt, the umpire may call the pitch a strike. This leads the batter into swinging at "balls", as the umpire chooses to call these pitches strikes that are in reality outside the strike zone.

Certain of these prior art devices, and the proposed manner of overcoming different problems, are more fully described in the following U.S. patents:

a.) U.S. Pat. No. 6,350,211, to Kolmar, discloses an image which includes one or more stakes to be driven into the ground to provide a stable support. By positioning the simulated image near the "home plate' the pitcher can use the image reference to determine the location of the strike zone.

b.) U.S. Pat. No. 5,704,855, to Kellog Jr., shows a general purpose portable pitching device comprised of a one-piece supporting base with spaced apart vertical parallel uprights affixed with horizontal parallel cross members, for forming a strike zone. The strike zone is fully adjustable in height and width and is easily disassembled for transport and storage.

c.) U.S. Pat. No. 4,199,141, to Garcia, teaches an apparatus comprising target blocks mounted within support racks and is used as a training device for teaching the art of correctly pitching a baseball, and has means to indicate if the throw was a 'ball' or a 'strike'.

While the foregoing prior art may teach or measure whether a pitch passes through the strike zone, these devices do not address the relationship between the pitcher and catcher, do not teach the proper positioning of the catcher and catcher's mitt, nor teach the pitcher how to work the edges of the plate. The manner by which the present invention achieves the goals hereof will become more apparent in the description which follows, particularly when read in conjunction with the accompanying drawings.

SUMMARY OF THE INVENTION

The present invention relates to the relationship between the pitcher and catcher, the teaching of the proper positioning of the catcher and catcher's mitt, and teaches the pitcher how to throw to certain locations over and near home plate. The invention comprises a low profile, ground supported device, preferably fabricated of a thermoplastic polymer, such as an acrylontrile butadiene styrene (ABS). The device comprises a generally planar base section having a front straight edge, operable to lie perpendicular to the line between the pitcher and catcher, and a pair of rear angled edges terminating in a pointed tip, and a pair of side sections, raised from the planar base, where the respective side sections include a pair of parallel edges, a front edge coextensive with the straight edge, and a rear angled edge terminating at a pointed tip. In the operable position, the exposed portion of the planar section will represent the center of the 'strike' zone, while the side sections represent the 'corners' or edges of the 'strike' zone. In a preferred embodiment, the coextensive edges of the side sections may be brightly painted or provided with a reflective tape to better define the side sections for the pitcher as he throws to the catcher. Further, the upper faces of the respective side sections may be provided with a light surface or reflective tape to visually distinguish the side sections from the upper surface of the planar base. It will be appreciated that since the pitcher's mound is elevated above the device, and the position of the catcher and potential batter, the pitcher can readily see the device and the different sections thereof, all without restricting the throwing and catching activity of the players.

Accordingly, a feature of this invention is the provision of a pitcher/catcher aid that provides an unobstructed view from the pitcher to the catcher.

Another feature hereof lies in the use of a teaching aid for pitchers and catchers that includes highly visual target areas to allow a pitcher to control his pitches within and without the strike zone.

A further feature of the invention is a color distinguishable middle portion that separates a pair of edge sections, where said middle portion and edge sections completely cover the traditional area of a conventional home plate.

These and other features of the invention will become clearer in the specification which follows, particularly when read in conjunction with the accompanying drawings.

DETAILED DESCRIPTION OF PREFERRED EMBODIMENT

Figure 1:
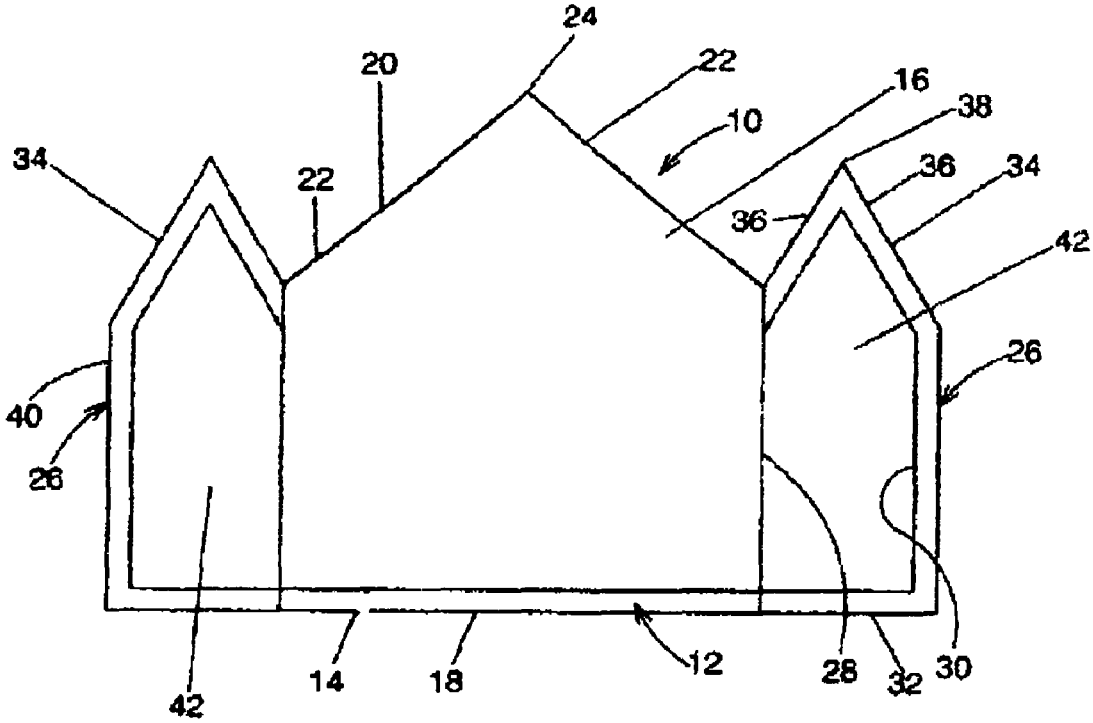
FIG. 1 is a top view showing the pitcher and catcher training aid according to the invention.

The present invention relates to a low profile, ground supported training tool for pitches and catchers that improves the relationship between the pitcher and catcher, by teaching the proper positioning of the catcher and catcher's mitt, and teaches the pitcher how to throw to certain locations over and near home plate, more precisely within and just outside the 'strike' zone. The invention will now be described with regard to the accompanying drawings, where like reference numerals represent like components or features in the two views.

Figure 2:
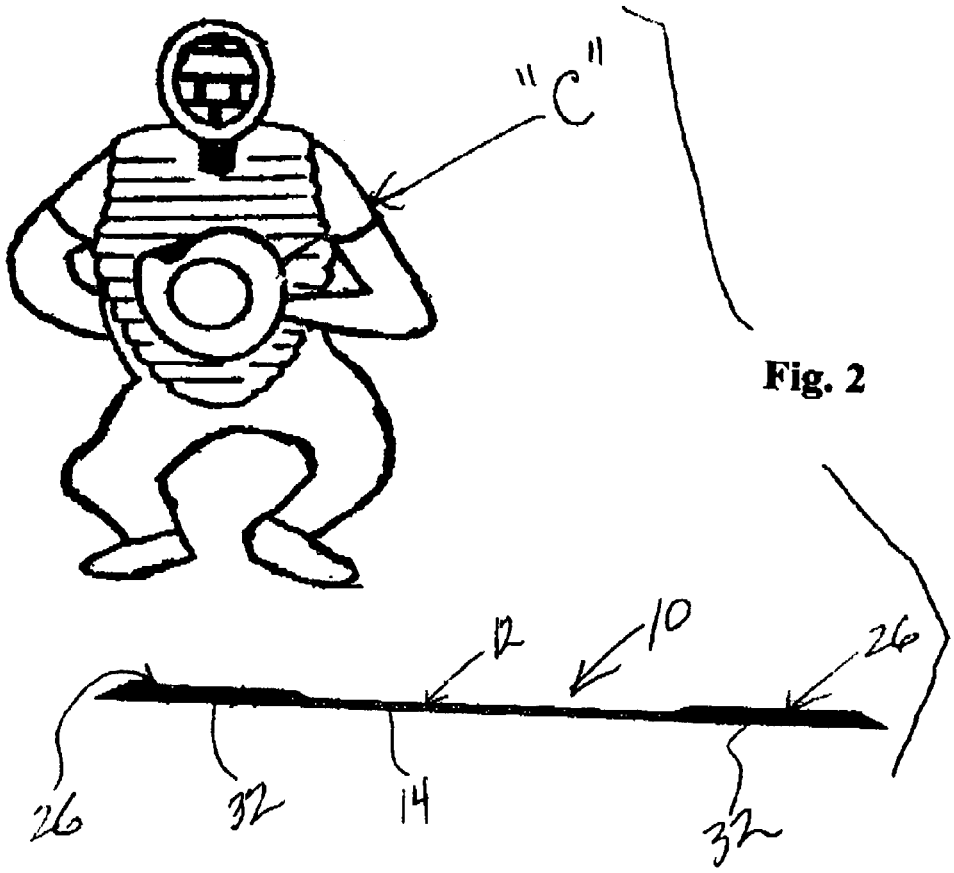
FIG. 2 is a front view thereof, showing the training aid hereof in relationship to the catcher positioned to receive the pitch, where the catcher is positioned for an outside pitch for a right-handed batter.

Turning now to FIGS. 1 and 2, illustrating top and front views, respectively, of the baseball training aid of this invention, there is shown the baseball training aid device 10 comprising a planar base section 12 for supporting on the ground. The base section is characterized by a flat lower surface 14 and an exposed upper surface 16, a straight front edge 18, and a rear edge 20 formed by a pair of diverging edges 22 terminating in a tip 24, where the tip is directed to the general position of the catcher behind the home plate.

Each side of the base section 12 contains a raised portion 26, see FIG. 2, where each raised portion 26 is defined by a pair of parallel edges 28, 30, a front edge 32 coextensive with said straight front edge 18, and a read edge 34 characterized by a pair of converging edges 36 that terminate at a tip 38. Like the tip 24, the respective tips 38 are directed rearwardly, to the general location of the catcher "C", see FIG. 2. One feature of the device 10, the purpose of which will become clearer hereafter, is that the coextensive front edge 18 and the respective front edges 32 are tapered forwardly.

Before continuing with the visual features of the device 10, while the device may be constructed of a variety of materials, a preferred material is an acrylonitrile butadiene styrene (ABS), a versatile family of engineering thermoplastics. These materials demonstrate good resistance to impact, even at low temperatures, and high electrical insulation that is unaffected by changes in humidity. By the combination of the three monomers, additional benefits are achieved. For example, this combination provides a product with a scuff and stain resistant, high gloss finish having anti-static properties to repel the attraction of airborne particles. Also, it has excellent dimensional stability and good environmental stress cracking resistance. The respective components each offer certain unique properties to the resultant product, namely:

Acrylonitrile—chemical resistance. heat stability, aging stability;

Butadiene—product toughness, impact resistance, property retention at low temperatures; and, Styrene—rigidity, surface appearance (gloss), processibility.

FIG. 2 illustrates a ground level front view showing primarily the low profile of the device 10. However, as known in the playing and setup of the game of baseball, the pitchers mound is elevated above the level of the batter, catcher "C" and home plate, by about six inches. Additionally, with the pitcher standing and throwing upright, he can easily see the top of the device 10 from the pitcher's mound. With that having been said, and returning to FIG. 1, the two side raised portions 26 reveal a brightly colored, or light reflective tape, to visually distinguish, for the pitcher, such raised portions from the straight front edge 18. Additionally, the periphery, defined by tapered side edges 40 and rear edge 34, may be colored to outline the face 42, where the latter may be colored in white or by a light reflective tape. This combination helps to clearly define the side zones for the pitcher, and to present a target position for the catcher, see FIG. 2. As the pitcher and catcher work together with the device 10, as taught above, the pitcher can better hone his pitching skills in finding the 'corners' of the home plate.

It is recognized that changes, variations and modifications may be made to the present invention and the materials suitable for manufacturing this invention, especially by those skilled in the art, without departing from the spirit and scope thereof. Accordingly, no limitation is intended to be imposed thereon except as set forth in the accompanying claims.

We claim:

1. A baseball training aid device to assist a pitcher and catcher in developing a pitchers skill to target precise locations established by said catcher spaced a straight line distance from said pitcher, said device comprising:

a.) a low profile, ground supported device to define said precise locations, said device having a base section with a top planar surface and featuring a generally straight edge arranged to lie perpendicular to said straight line distance between said pitcher and said catcher; and, b.) a pair of spaced apart, raised side sections mounted on said base section and extending above said top planar surface, each said side section having a front edge coextensive with said straight edge, where said front edge is provided with a distinguishable colored surface from said straight edge, and an upper surface having a distinguishable colored surface from said top planar surface of said base section.

2. The baseball training aid device according to claim 1, wherein said straight edge and said front edges are tapered in a forward direction.

3. The baseball training aid device according to claim 2, wherein each said raised side section is characterized by said front edge, spaced apart, parallel side edges, and an arrow like rear edge formed by a pair of converging edges.

4. The baseball training aid device according to claim 3, wherein parallel side edges and said rear edge are tapered.

5. The baseball training aid device according to claim 1, wherein said base section and said raised side sections are fabricated of a thermoplastic characterized by its resistance to impact, scuff and stain resistant, and exhibits a high gloss finish having anti-static properties to repel the attraction of airborne particles.

6. The baseball training aid device according to claim 5, wherein said thermoplastic is a combination of tree monomers consisting of acrylonitrile, butadiene and styrene.

7. The baseball training aid device according to claim 3, wherein said side sections are further characterized by said upper surface featuring a light reflective surface.

* * * * *